US005463692A

United States Patent [19]

Fackler

[11] Patent Number: 5,463,692

[45] Date of Patent: Oct. 31, 1995

[54] SANDWICH SWITCH CONSTRUCTION FOR A HEARING AID

[75] Inventor: Ricky L. Fackler, White Bear Lake, Minn.

[73] Assignee: Resistance Technology Inc., Vadnais Heights, Minn.

[21] Appl. No.: 273,200

[22] Filed: Jul. 11, 1994

[51] Int. Cl.[6] ..... H04R 25/00; H01H 19/58; H01H 35/00

[52] U.S. Cl. ..... 381/68; 381/68.7; 200/52 R; 200/11 R

[58] Field of Search ..... 381/68, 68.6, 68.7, 381/69, 23.1; 200/11 R, 16 R, 52 R

[56] References Cited

U.S. PATENT DOCUMENTS

| | | | |
|---|---|---|---|
| 3,221,111 | 11/1965 | Groot et al. | 179/107 |
| 3,629,780 | 12/1971 | Burcham | 338/198 |
| 4,405,841 | 9/1983 | Van Zeeland | 200/11 R |
| 4,539,440 | 9/1985 | Sciarra | 179/107 |
| 4,634,815 | 1/1987 | Marquis | 387/68.4 |
| 4,710,961 | 12/1987 | Büttner | 381/68.7 |
| 4,918,264 | 4/1990 | Yamamoto et al. | 200/16 R |
| 4,922,540 | 5/1990 | Erbe | 381/69 |

OTHER PUBLICATIONS

Operating Principle regarding Dyna–Graphics Membrane Switch—Jun. 1992.

*Primary Examiner*—Curtis Kuntz
*Assistant Examiner*—Sinh Tran
*Attorney, Agent, or Firm*—Kinney & Lange

[57] ABSTRACT

A sandwich switch construction for a hearing aid includes a lower housing having a base surface with a first electrical lead formed thereon, and an elastomeric membrane with a second electrical lead formed thereon in alignment with the first electrical lead, a portion of the elastomeric membrane being spaced apart from the base surface such that the first electrical lead is not in communication with the second electrical lead; and an upper housing operable with the lower housing, the upper housing having contact mechanism for deforming the elastomeric membrane toward the base surface such that the first electrical lead is in electrical communication with the second electrical lead.

12 Claims, 8 Drawing Sheets

SANDWICH SWITCH CONSTRUCTION FOR A HEARING AID

BACKGROUND OF THE INVENTION

The present invention relates generally to hearing aids, and more particularly, to hearing aids having a sandwich type switch construction with a deformable elastomeric membrane.

Hearing aids require switches which are used for a variety of purposes including on/off control, volume control, trimmer applications such as noise filtration control, and telecoil control such as a telephone receiver mode, etc. Hearing aid switches for both in-the-ear hearing aids and behind-the-ear hearing aids must be miniature to fit within the small space requirements of the hearing aid housings and to maintain the aesthetic qualities of hearing aids.

Conventional wiper switches used in hearing aids include a wiper having a first end electrically and pivotally coupled to circuitry and a second or contact end which is wiped across either a nonconductive surface to open the switch or across a conductive surface to close the switch. The wiper switch is constructed to wipe across a variable resistance path if the wiper switch is to used for volume control or noise filtration. However, wiper switches have several drawbacks. Since the voltage through hearing aid circuits is low, wiper switches require precise fabrication to ensure electrical contact and to avoid generating electrical noise. Precise fabrication is costly and requires the use of miniature parts which are difficult to handle and which tend to wear out and cause the switch to malfunction.

A push button switch is disclosed in U.S. Pat. No. 4,634,815 to Marquis for turning the hearing aid on and off and for volume control. The switch is activated by rotating the button such that a contact tongue contacts a contact member to close a circuit. To control the volume, the push button is pressed causing a diaphragm to depress and close another circuit. Volume control is either limited to two settings or is changed in proportion to the time period for which contact is maintained.

SUMMARY OF THE INVENTION

The present invention relates to a sandwich switch construction for a hearing aid which includes a lower housing having a base surface or a rigid circuit board or flexible circuit with a first electrical lead defined thereon, and an elastomeric membrane with a second electrical lead formed thereon in alignment with the first electrical lead. A portion of the elastomeric membrane is spaced apart from the base surface such that the first electrical lead is not in electrical communication with the second electrical lead wherein the sandwich switch is open. An upper housing operable with the lower housing has contact means associated therewith operable between a first position wherein the elastomeric membrane is deformed toward the base surface such that the first electrical lead is in electrical communication with the second electrical lead wherein the sandwich switch is closed, and a second position wherein the elastomeric membrane is deformed away from the base surface wherein the sandwich switch is open.

In one embodiment the upper housing is rotatably mounted to the lower housing, and the contact mechanism includes a cam fixedly mounted to the upper housing such that rotation of the upper housing causes the cam to contact and compress the spaced apart portion of the elastomeric membrane such that the first and second leads are in electrical communication.

In another embodiment, the contact mechanism includes a toggle pivotally mounted within the upper housing for moving the first and second leads into and out of communication with each other. The toggle pivots in a first direction such that the toggle contacts and compresses the spaced apart portion of the elastomeric membrane such that the first and second leads are in communication with each other and in a second direction such that the toggle is not in contact with the spaced apart portion of the elastomeric membrane such that the spaced apart portion of the elastomeric membrane deforms back to its original position such that the first and second leads are not in communication with each other.

In a further embodiment the contact mechanism includes a slide slidably mounted within a track in the upper housing for moving the first and second leads into and out of communication with each other. The slide is slidable within the track in a first direction such that the slide contacts and compresses the spaced apart portion of the elastomeric membrane such that the first and second leads are in communication with each other and in a second direction such that the slide is not in communication with the spaced apart portion of the elastomeric membrane such that the spaced apart portion of the elastomeric membrane deforms back to its original position such that the first and second leads are not in communication with each other.

Other embodiments are contemplated such as where the contact mechanism is in the form of a push button switch, a momentary switch or a side wall switch.

DETAILED DESCRIPTION OF THE PREFERRED EMBODIMENTS

Figure 1:
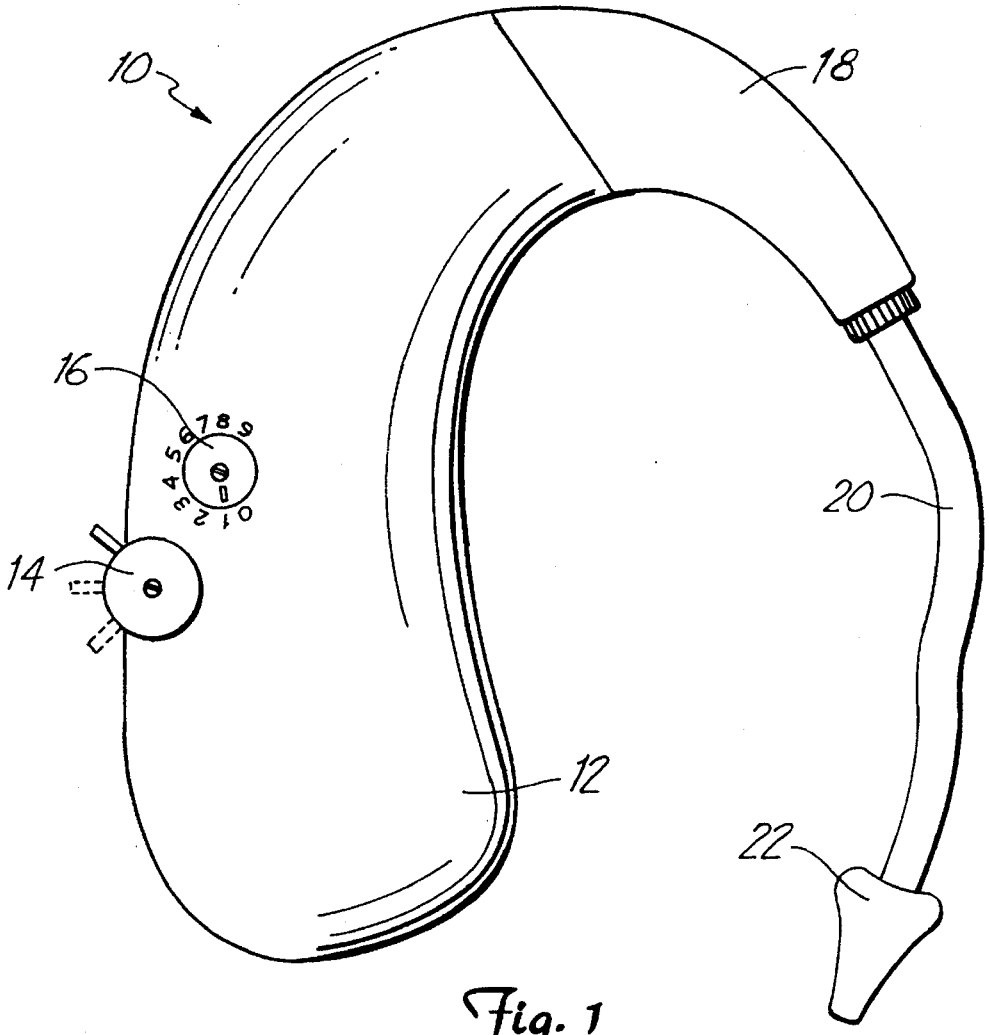
FIG. 1 is a side elevational view of a hearing aid having a three-position switch and a volume control switch made according to the present invention.

A hearing aid illustrated generally at 10 in FIG. 1, includes a housing 12, containing electrical processing components such as a microphone, receiver, amplifier and speaker (not shown) for processing acoustic signals. A three-position switch 14 is mounted to the housing 12 for switching between various hearing aid functions such as noise filtration and telephone receiver mode. An on/off, volume control switch 16 is also mounted to the housing 12 for adjusting the volume of the acoustic signals and turning the hearing aid 10 on and off. A carrying hook 18 connected to the housing 12 hangs the hearing aid 10 from an ear of a person wearing the hearing aid 10. A hose 20 secured to the carrying hook 18 transmits the processed acoustic signals from the carrying hook 18 to an ear adaptor 22. The ear adapter 22 fits in the auditory canal of the person using the hearing aid for transmitting acoustic sounds from the hose 20 to the person. The housing 12, the carrying hook 18, the hose 20, and the ear adapter 22 are well known components and are constructed in a conventional manner known to persons skilled in the art. Although a behind-the-ear hearing aid 10 is illustrated, it is to be understood that the present invention may be used with an in-the-ear hearing aid as well.

Figure 2:
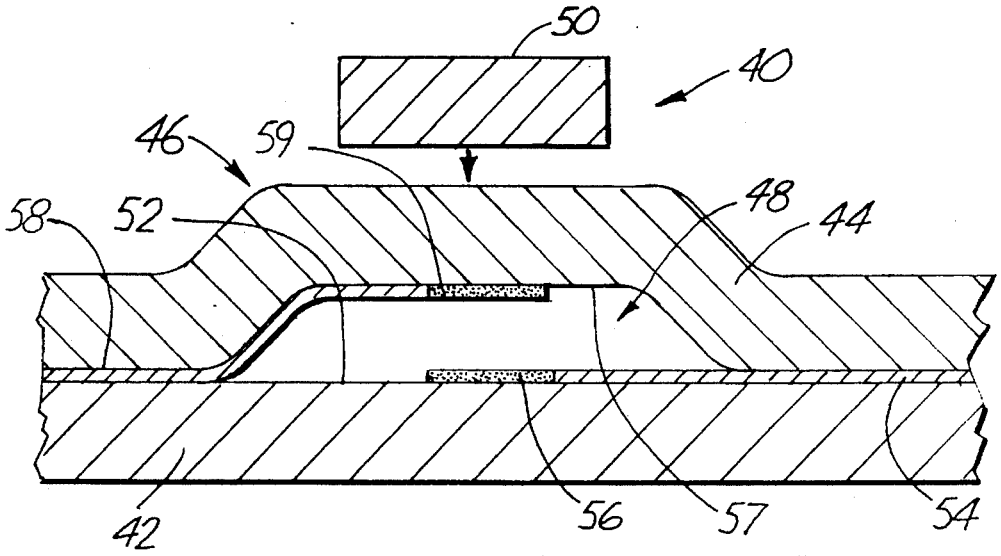
FIG. 2 is a sectional view of a sandwich switch made according to the present invention.

Referring to FIG. 2, a typical sandwich switch according to the present invention is illustrated generally at 40. The sandwich switch 40 includes a base layer 42, an elastomeric membrane 44 mounted to the base layer 42 such that a portion of the elastomeric membrane 44 is spaced apart from the base layer 42 to form a tactile dome 46 having a gap 48, and a contact mechanism 50 for deforming the tactile dome 46 of the table elastomeric membrane 44 towards the base layer 42 to activate and deactivate the sandwich switch 40. A conductive ink is screened, plated or molded (conductive rubber) into an upper surface 52 of the base layer 42 to form a first lead 54 and a first contact 56, and also onto a lower surface 57 of the elastomeric membrane 44 to form a second lead 58 and a second contact 64. The first contact 56 and the second contact 64 are formed under the tactile dome 46 in the gap 48 between the base layer 42 and the elastomeric membrane 44 and are aligned with each other such that when the contact mechanism 50 deforms the elastomeric membrane 44 the first and second contacts 56 and 64 are put into communication with each other to activate the sandwich switch 40. The tactile domes 46 completely seal off the first and second contacts 56 and 59 such that water, sweat, moisture, dust, oils, and other contaminants are kept away from the sandwich switch 40 thereby increasing the reliability of the switch. The first and second leads 54 and 58 are connected to circuitry (not shown) for performing various functions such as volume control, noise reduction, telephone mode, etc. The base layer 42 may be an elastomeric membrane or plastic material with leads formed thereon, or of a rigid circuit board or flexible circuit construction with defined electrical traces and contacts thereon. Of course, the construction of the electrical leads and traces will differ depending on whether an elastomeric membrane, rigid circuit board or flexible circuit construction is used for forming the sandwich switches thereon.

The sandwich switch 40 may be constructed, for example, by screening, plating or molding a conductive ink path on both the upper surface 52 of the base layer 42 and on the lower surface 51 of the elastomeric membrane 44 to form the first and second leads 54 and 58 and the first and second contacts 56 and 59. The conductive ink is well known to those skilled in the art.

The elastomeric membrane 44 maybe constructed of a thin polyester film, or any type of flexible material such as molded silicon, conductive rubbers, or grafite filets. If constructed of polyester, the elastomeric layer is approximately 0.003"–0.020" thick, although the thickness will vary depending on the material used. Depending on the material used for the elastomeric membrane 44, the thickness is reduced at the tactile dome 46 to facilitate the deformation of the elastomeric membrane 44 to close the switch. The lower surface 57 of the upper elastomeric layer 44 is sealed to the upper surface 52 of the base layer 42 by heat staking, cold slug staking, ultra sonic welding, double molding, etc. or by using a permanent acrylic adhesive or other sealing agent such that the gap 48 is created between the first and second contacts 56 and 59. Insulative layers (not shown) may be screened over the conductive ink with openings for the first and second contacts 56 and 59, but are not necessary if the first and second leads 54 and 58 are oriented so as not to interfere with each other to short circuit the sandwich switch 40.

The sandwich switch 40 construction of the present invention will now be described with respect to the three-position switch 14 and the volume control switch 16. It is to be understood that the present invention is not limited to use in a particular type of switch and that the number of, arrangement of, an attached circuitry to the sandwich switches 40 will vary depending on the type of switch in which the sandwich switches 40 are being used. The general structure and principles of operation of the sandwich switch 40 is the same regardless of the type or shape of switch. It is also to be understood that the sandwich switch 40 construction is not limited to hearing aid uses, since it can be used in any environment where it is desirable to provide a miniature switch which does require handling the miniature components to construct or operate the switch.

Figure 3:
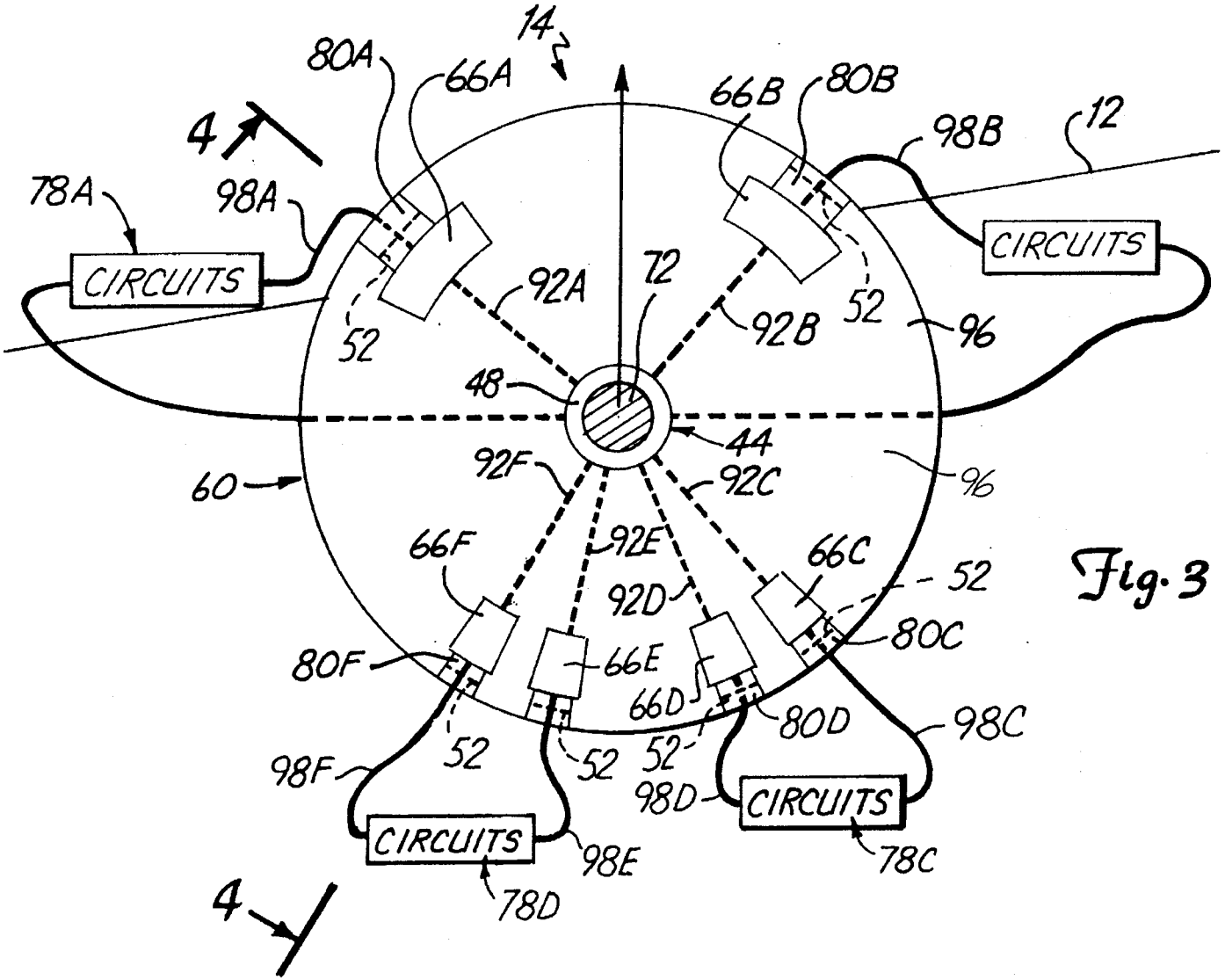
FIG. 3 is a diagrammatic plan view of a stator layer of the three-position switch made according to the present invention.
Figure 4:
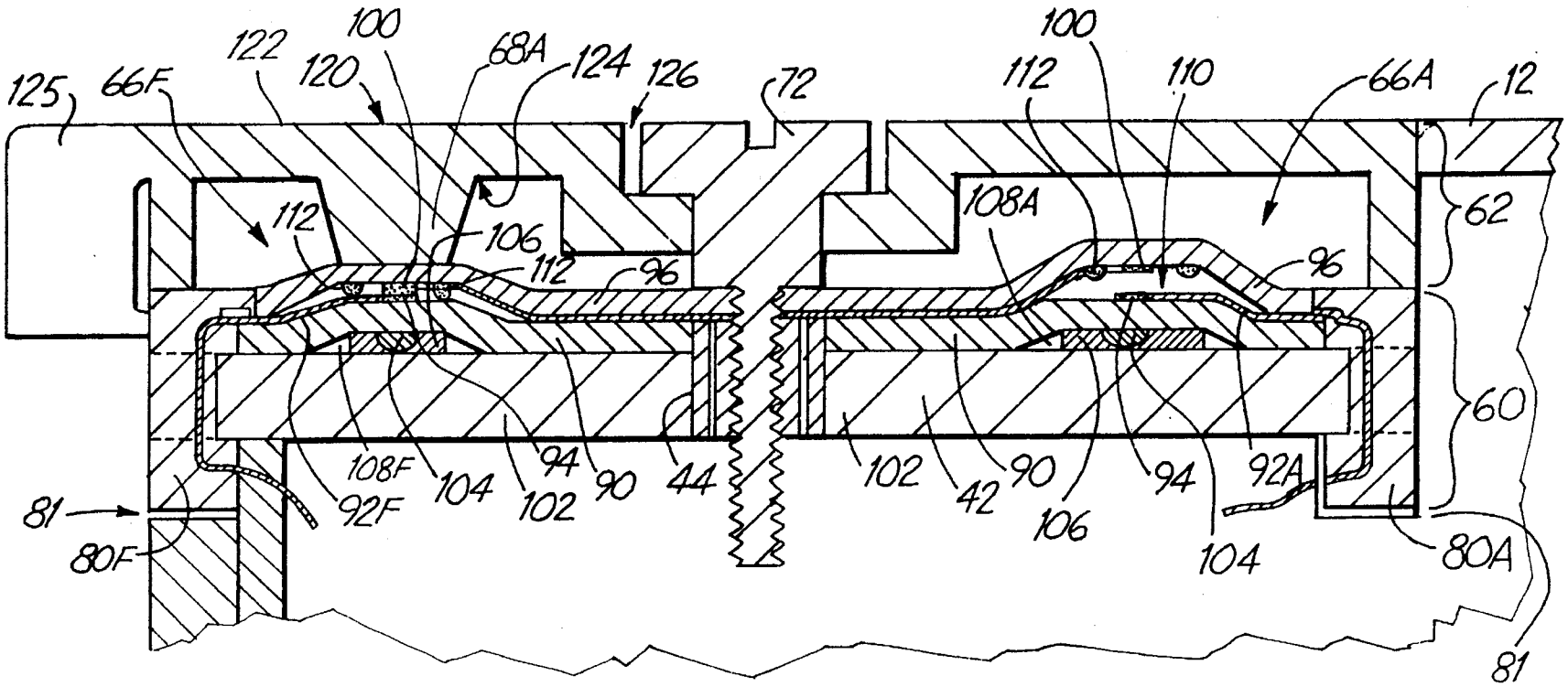
FIG. 4 is a sectional view of the three-position switch as seen from line 4—4 in FIG. 3.
Figure 5:
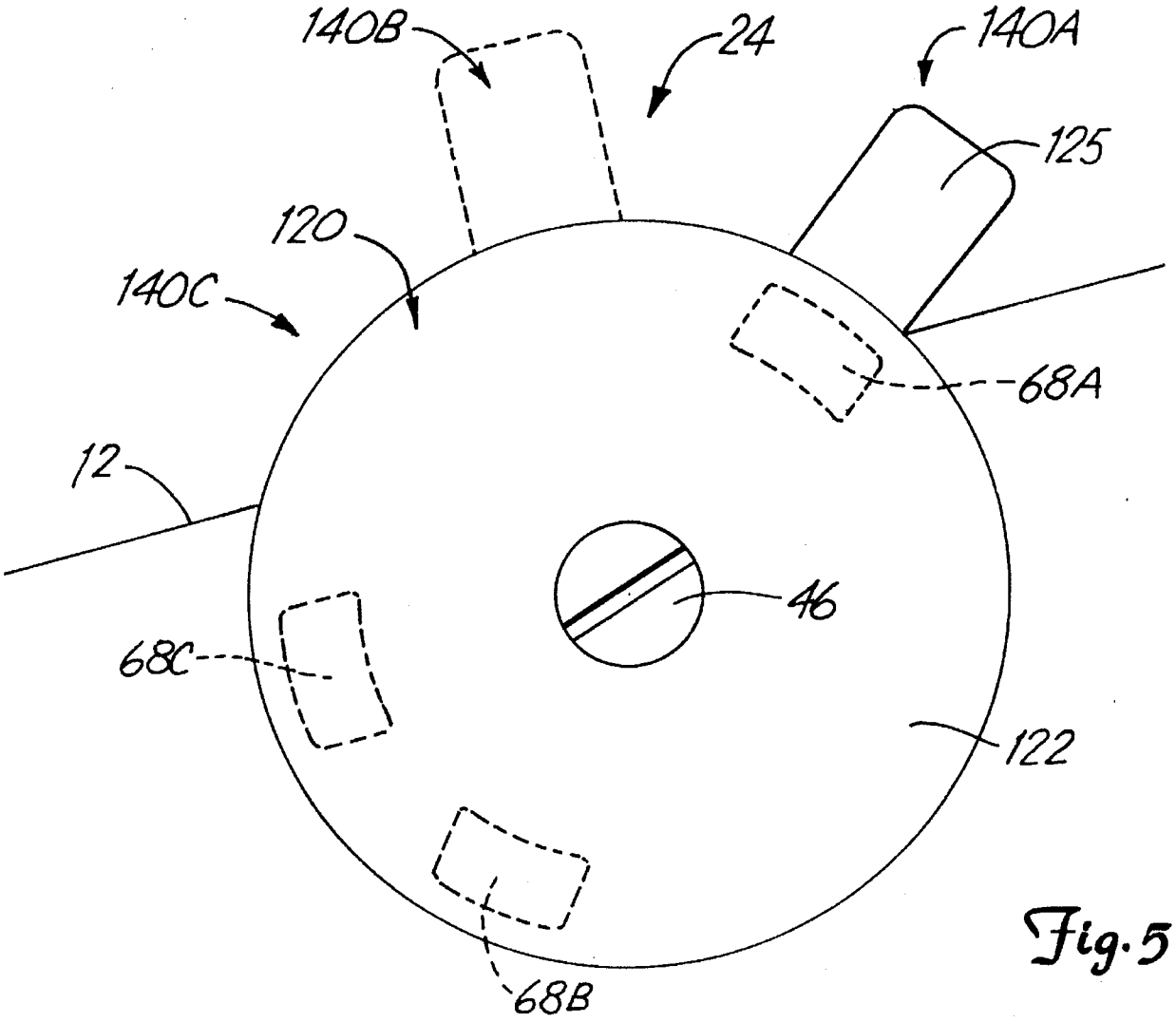
FIG. 5 is a top plan view of a rotor layer of the three-position switch in position 1 made according to the present invention.

Referring to FIG. 3–5, the three-position switch 14 includes a disc-shaped stator layer 60 fixedly mounted to the housing 12, a disc-shaped rotor layer 62 rotatably mounted to the stator layer 60, a plurality of sandwich switches 66A–66F formed on the stator layer 60 adjacent the rotor layer 62, and a plurality of cams 68A–68C mounted on the rotor layer 62 for engaging and disengaging the sandwich switches 66A–66F upon rotation of the rotor layer 62. A shoulder screw 72 and a nut 74 operate with a hole in the stator and rotor layers 60 and 62 for securing the switch 14 to the housing 12. Instead of the shoulder screw 72, a plastic stud or other locking adaptor may be used. The three position switch 14 is preferably less than or equal to 0.400 inches in diameter and less than or equal to 0.300 inches in thickness and is used to switch between three hearing aid functions such as telephone mode, noise filtration mode and on/off mode, etc.

Referring to FIG. 3, in the illustrated embodiment, two sandwich switches 66A and 66B are constructed in one half of the stator layer 60 and four sandwich switches 66C–66F are constructed in the other half of the stator layer 60. Sandwich switch 66A–66B are associated with circuitry units 78A and 78B, respectfully, for performing hearing aid functions and are single activation switches meaning that each circuit 78A and 78B is closed when the respective sandwich switch 66A, 66B is activated. Sandwich switches 68C–68F are associated with circuitry units 78C and 78D and are arranged in pairs and connected in series within each pair to form double activation switches meaning that each circuit 78C and 78D is closed only when the respective pair of sandwich switches 68C–68D, and 68E–68F is activated. The lower lead of each sandwich switch 66A–66F runs towards the center of the stator layer 60 either for connection to circuity within the hearing aid or for connection to one of the other sandwich switch leads to form a double activation switch. Referring to FIGS. 3 and 4, the upper lead of each sandwich switch 66A–66F runs through a U-shaped lead connector 80A–80F positioned on the periphery of the stator layer 60 for connecting the sandwich switches 68A–68F to circuitry units 78A–78D within the hearing aid 10. The connectors 80A–80F aid in mounting the stator layer 60 to the housing 12 since each lead connector 80A–80F is engagable with a corresponding slot 81 in the housing 12. It should be apparent to those skilled in the art that termination of the leads could be through a socketed device and does not have to be hard wired as shown.

Still referring to FIGS. 3 and 4, each sandwich switch 66A– 66F includes a lower elastomeric layer 90 having a plurality of lower leads 92A–92F and lower contacts 94 screened thereon, an upper elastomeric layer 96 having a plurality of upper leads 98A–98F and upper contacts 100 screened thereon corresponding to the lower leads 92A–92F and lower contacts 94 on the lower elastomeric layer 90, a travel spring 104 and a foam donut or O-ring 106. The lower elastomeric layer 90 is mounted to a stator base 102 such that portions of the lower elastomeric layer 90 are spaced apart from the stator base 102 forming a plurality of first gaps 108A–108F below the lower contacts 94 of each sandwich switch 66A–66F. The travel spring 104 and the foam donut 106 are positioned in each of the plurality of first gaps 108A–108F for supporting the lower elastomeric layer 90 and for providing a resilient force for returning the lower elastomeric layer 90 to its original position as it may be deformed when the sandwich switch 66A–66F is closed. The foam donut or O-ring 106 may take of any form provided the resilient return force is generated.

The upper elastomeric layer 96 is mounted to the lower elastomeric layer 90 to insulate the leads on both elastomeric layers 90 and 96 and also such that portions of the upper elastomeric layer 96 are spaced apart from the lower elastomeric layer 90 forming a plurality of tactile domes having second gaps 110 separating the lower contacts 94 from the upper contacts 100.

A pair of non-conductive contact brakes 112 are screened onto the upper elastomeric layer 96 in each second gap 110 on opposite sides of each upper contact 100 to assure adequate spacing of the second gap 110 to prevent inadvertent contact between the upper and lower contacts 94 and 110 when the sandwich switch 66A–66F is open and to prevent the second gap 110 from deteriorating over time. It is to be understood that the contact brakes 112 may also be screened onto the lower elastomeric layer 90.

Referring to FIGS. 4 and 5, the rotor layer 62 includes a disc-shaped cover 120 having a top surface 122, a bottom surface 124, and a handle 125. A recessed portion 126 in the center of the rotor layer 62 operates with the shoulder screw 72 to rotatably mount the cover 120 to the stator layer 60. The first cam 68A, the second cam 68B and the third cam 68C are mounted on the bottom surface 124 of the cover 120 for activating the sandwich switches 66A–66F. As the cover 120 is rotated, each cam 68A– 68C contacts and deforms the upper elastomeric layer 96 towards the lower elastomeric layer 90 such that lower contact 94 engages the upper contact 100 to close the sandwich switch 66A–66F. When the cam 68A–68C is no longer in contact with the upper elastomeric layer 96, the upper elastomeric layer 96 springs back to its original position thereby separating the lower and upper contacts 94 and 100 from each other and opening the sandwich switch 66A–66F. The cams 68A–68C may be dimensioned to contact two sandwich switches if a "make-before-break" connection is desired. The sides of the cams 68A–68C are sloped slightly inwardly to ensure smooth engagement between the cams 68A–68C and the upper elastomeric layer 96.

As the cover 120 is rotated, the cams 68A–68C move between a first position 140A, a second position 140B, and a third position 140C. Referring to FIGS. 3 and 5, in the first position 140A, the first cam 68A closes sandwich switch 66A, the second cam 68B simultaneously closes sandwich switches 66E and 66F, and the third cam 68C does not engage any of the sandwich switches. In the second position 140B, the first cam 68A does not engage any of the sandwich switches, the second cam 68B closes sandwich switches 66C and 66D, and the third cam 68C closes sandwich switches 66E and 66F. In the third position 140C, the first cam 68A closes sandwich switches 66A, the second cam 68B does not engage any of the sandwich switches, and the third cam 68C closes sandwich switches 66C and 66D. It is to be understood that the number and placement of the cams 68A–68C, and the number, placement and activation sequence of sandwich switches 66A–66F may vary to suit particular design considerations.

Other exemplary embodiments of the present invention are illustrated in FIGS. 6–9. The various elements illustrated in FIG. 6–9, which correspond to elements described above with respect to the embodiment illustrated in FIG. 3–5 are designated by corresponding reference numerals increased by one hundred, two hundred and three hundred, respectively. All additional elements illustrated in FIGS. 6–9 which do not correspond to elements described above with respect to FIGS. 3–5 are designated by new reference numerals. Unless otherwise stated, the elements of FIG. 6–9 operate in the same manner as the embodiments of FIGS. 3–5.

Figure 6:
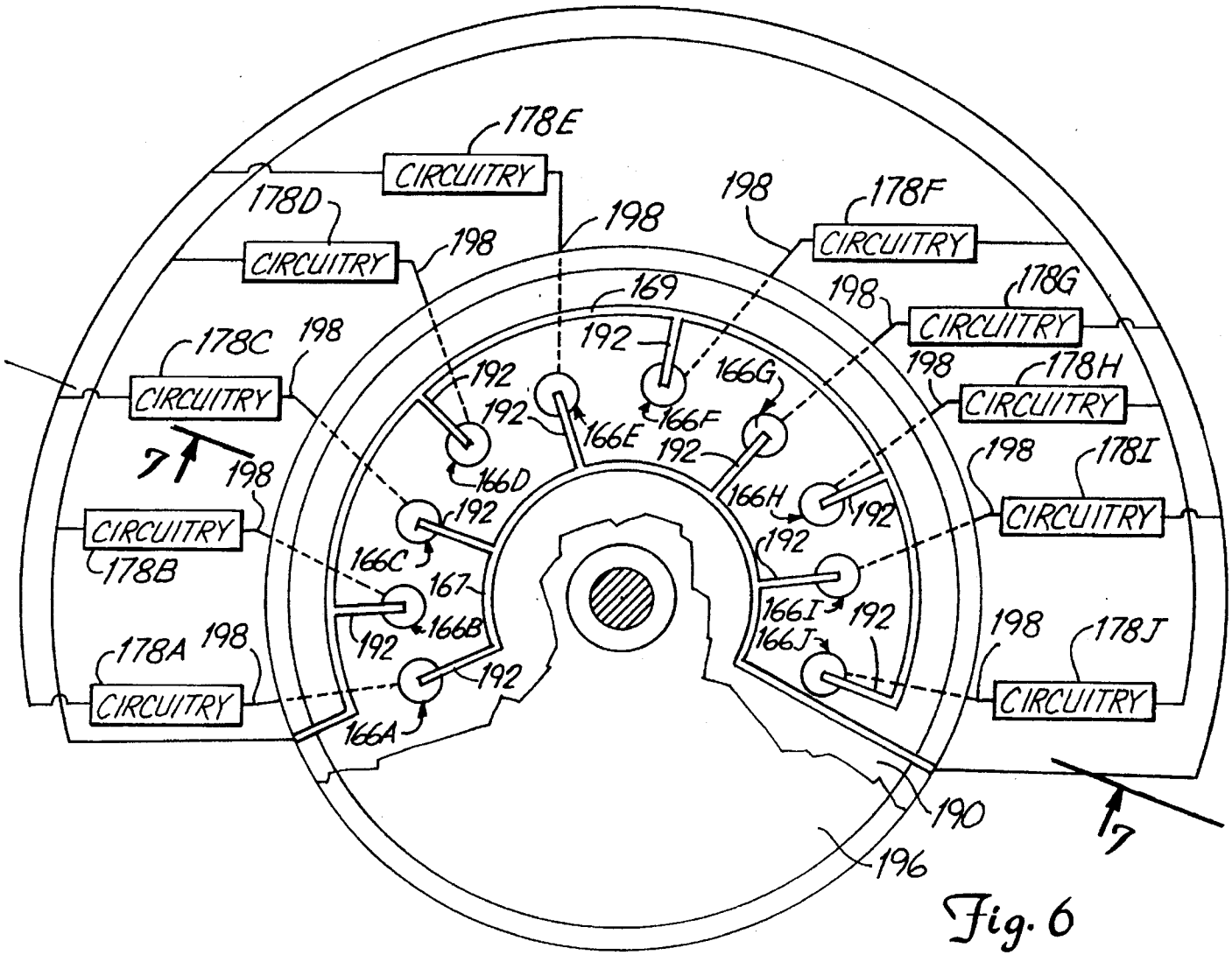
FIG. 6 is a diagrammatic plan view of a stator layer of a volume control.
Figure 7:
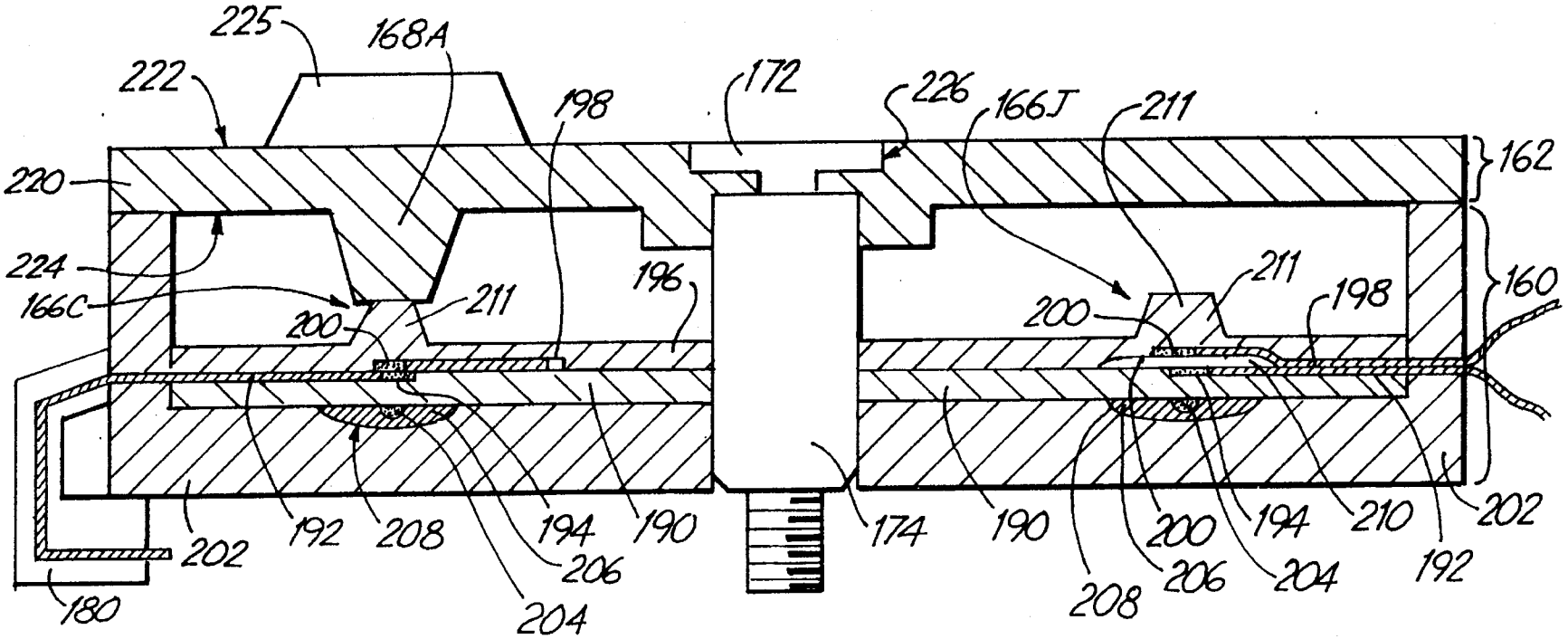
FIG. 7 is a sectional view of the volume control as seen from line 7—7 in FIG. 6.

Referring to FIGS. 6 and 7, the volume control switch 16 includes a disc-shaped stator layer 160 having a stator base 202 and ten (10) sandwich switches 166A–166J thereon, and a rotor layer 162 rotatably mounted to the stator layer 160 and having a single cam 168A formed thereon for activating and deactivating the sandwich switches 166A–166J.

The ten (10) sandwich switches 166A–166J formed on the stator base are arranged adjacent one another to represent incremental volume levels where the first sandwich switch 166A represents an on/off position. Each sandwich switch 166A–166J includes a lower elastomeric layer 190 having a plurality of lower leads 192 and lower contacts 194 screened thereon, an upper elastomeric layer 196 having a plurality of upper leads 198 and upper contacts 200 screened thereon corresponding to the lower leads 192 and lower contacts 194 on the lower elastomeric layer 190, a travel spring 204 and a foam or rubber donut 206. The stator base 207 has a first gap 208 formed thereon corresponding to the location of each sandwich switch. The lower elastomeric layer 190 is adhesively bonded, heat staked or fused, etc. to the stator base 207 and overlies each of the first gaps 208. The travel spring 204 and foam or rubber donut 206 are positioned in each of the plurality of first gaps 208 for supporting the lower elastomeric layer 190 and for providing a resilient force for returning the lower elastomeric layer 190 to its original position as it may be deformed when the sandwich switch 166A–166J is closed.

The upper elastomeric layer 196 is mounted to the lower elastomeric layer 190 by heat staking, cold staking, fusing, sonic bonding, etc. or by a permanent acrylic adhesive, to insulate the leads on both layers 190 and 196 and also such that portions of the upper elastomeric layer 196 are spaced apart from the lower elastomeric layer 190 forming a plurality of second gaps 110 separating the upper and lower contacts 199 and 200 from each other. An upper surface of the upper elastomeric layer 196 has a ridge 211 formed thereon corresponding to each sandwich switch for engaging the cam 168A. The ridge 211 is sloped inwardly to insure smooth engagement between the cam 168A and the sandwich switches 166A–166J.

The sandwich switches 166A–166J are connected to hearing aid circuity units 178A–178J, respectfully, for controlling the volume incrementally and turning the hearing aid 10 on and off. The lower leads 192 of sandwich switches 166A, 166C–166E, 166G and 166I are connect to a common inner lead 167 while the lower leads 192 of sandwich switch 166B, 166D, 166F, 166H, 166J are connected to a common outer lead 169. U-shaped lead connectors 180 or a socketed device (not shown) connect the upper leads 198 of each sandwich switch to the circuitry units 178A–178J, respectively, and aid in securing the switch 16 to the housing.

The rotor layer 162 is rotatably mounted on the stator layer 160 and includes a disc shaped cover 220 having a top surface 222, a bottom surface 224, and a recessed center portion 226 in the center of the rotor layer 162. The shoulder screw 172 mounts the rotor layer 162 to the stator layer 160 through a hole in the recessed center portion 226 of the rotor layer 160. A handle 225 is formed on the top surface 222 of the cover 220 for movement of the cover 220 and rotation of the rotor layer 162. The cam 168A is formed on the bottom surface 224 of the cover 220 for activating and deactivating the sandwich switches 166A–166J. The sides of the cam 168A are sloped slightly outwardly to ensure smooth engagement between the cam 168A and the sandwich switches 166A–166J. As the cover 220 is rotated, the cam 168A assumes one of ten positions corresponding to the locations of the sandwich switches 266A–266J. In each of the ten positions, the cam 168A deforms the upper elastomeric layer 196 towards the lower elastomeric layer 190 to cause the upper and lower contacts 194 and 200 to engage to close the sandwich switch 166A–166J.

Figure 8:
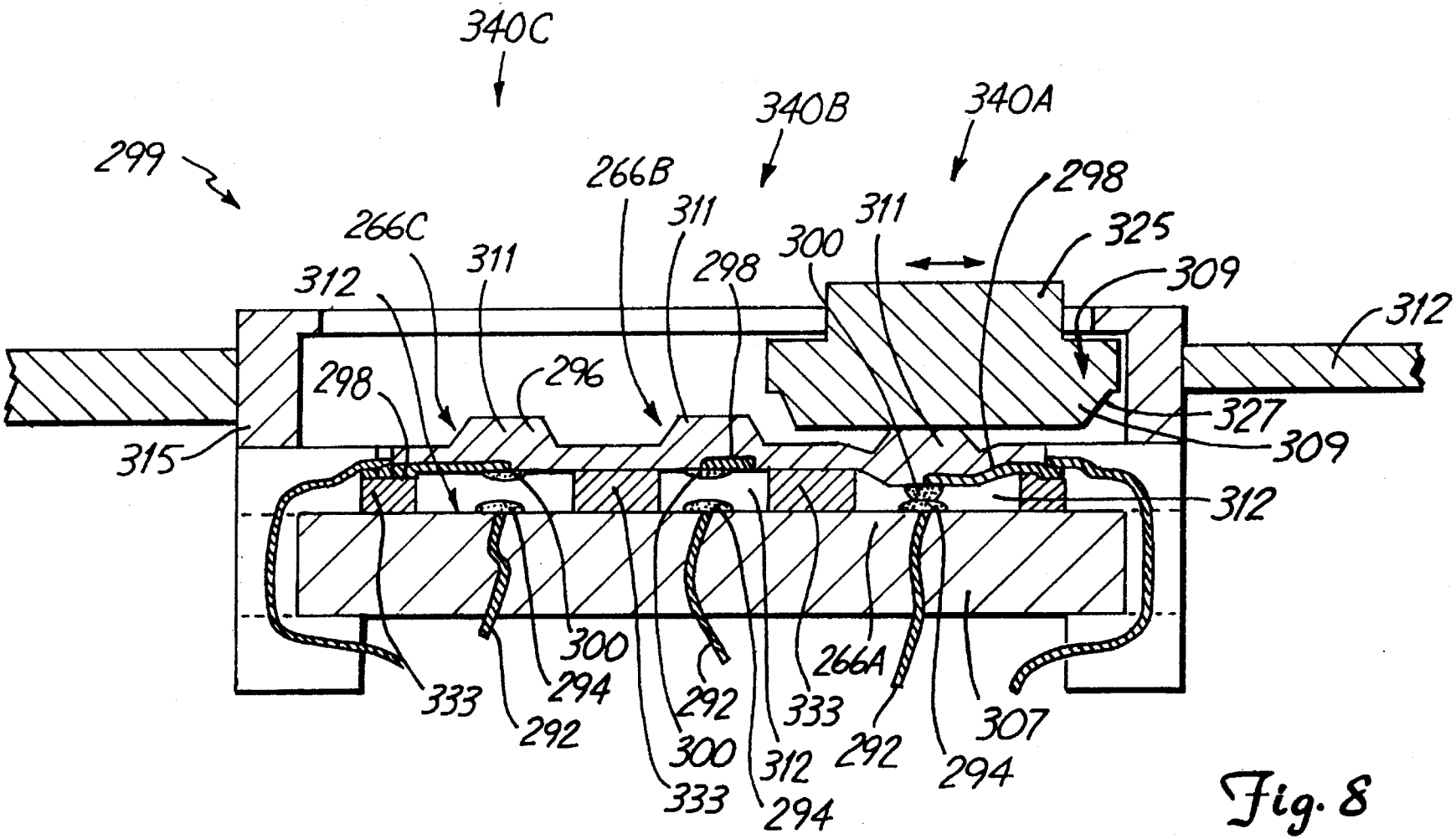
FIG. 8 is a sectional view of a second embodiment of the switch made according to the present invention.

Referring to FIG. 8, a second embodiment of the present invention is illustrated in the form of a the three-position slide switch, generally indicated at 299. The slide switch 299 includes a base 307 mounted in a hearing aid housing 312, a first sandwich switch 266A, a second sandwich switch 266B, a third sandwich 266C all mounted on the base 307, and a sliding member 309. The sliding member 309 is slidably mounted within a switch housing 315 for movement between a first position 340B in which the first sandwich switch 266A is activated, a second position 340B in which the second sandwich switch 266B is activated and a third position 340C in which the third sandwich switch 266C is activated. The sliding member 309 is shaped to contact only one sandwich switch 266A– 266C at a time, but may have a dimension to contact two sandwich switches 266A–266C at a time if a "make-before-break" connection is desired. A handle 325 mounted to a top surface of the sliding member 309 and extending beyond the switch housing 315 is used to move the sliding member 309 between the first, second and third positions 340A–340C. The sides 327 of the sliding member 309 are sloped slightly inward to ensure smooth engagement with the tactile domes formed by the sandwich switches 266A– 266C.

In this embodiment of the present invention, the sandwich switches 266A–266C, the lower leads 292 and lower contacts 294 are formed directly on the base 307 and the upper leads 298 and upper contacts 300 are formed on an upper elastomeric layer 296. A spacing layer 333 is screened over the lower leads 292 with openings for the lower contacts 294.

Figure 9:
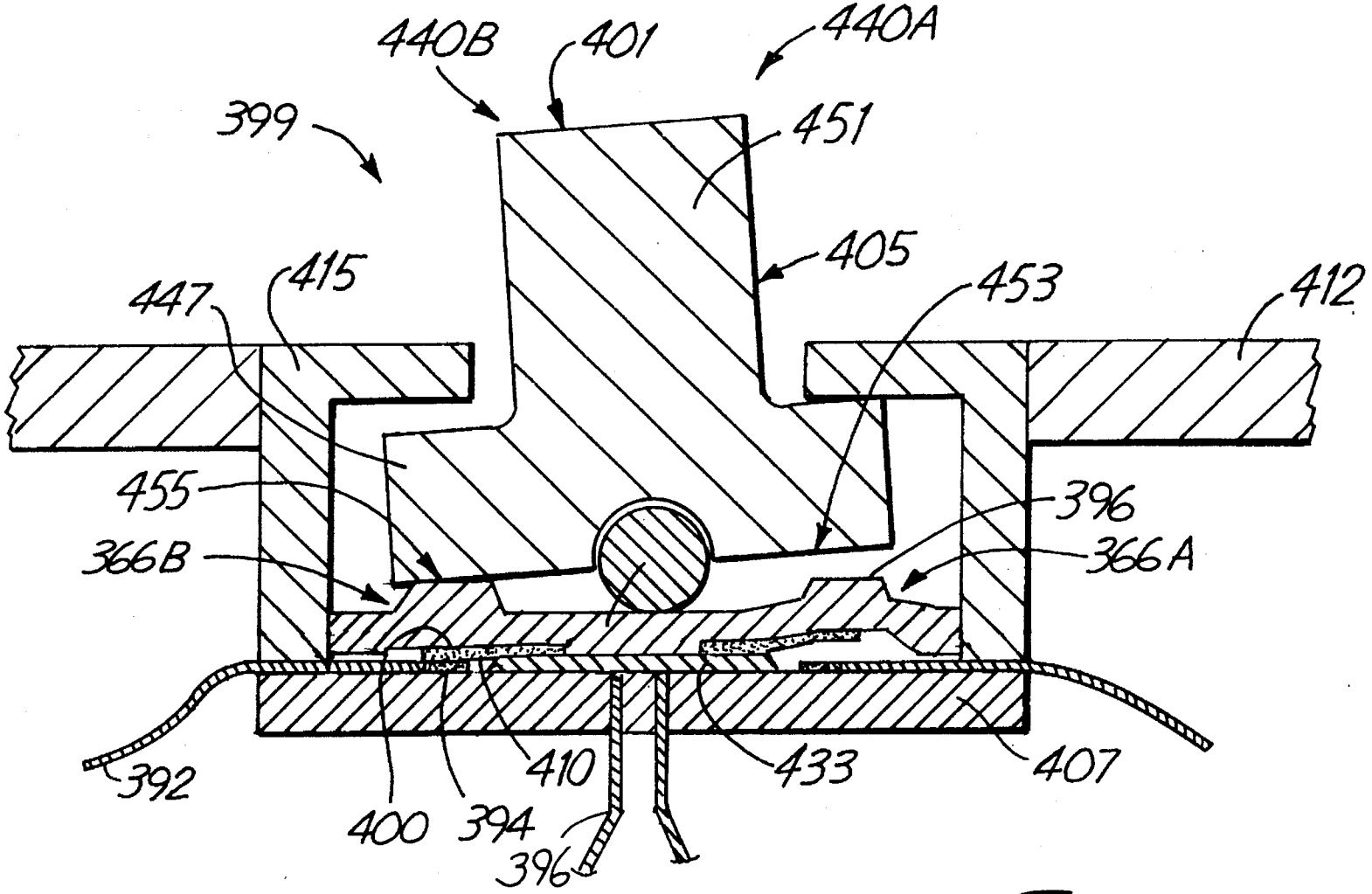
FIG. 9 is a sectional view of a third embodiment of a switch made according to the present invention.

Referring to FIG. 9, a third embodiment of the present invention is illustrated in the form of a two position toggle switch, generally indicated at 399. The toggle switch 399 includes a base 407 mounted to a hearing aid housing 412, a first sandwich switch 366A, a second sandwich switch 366B both mounted in a switch housing 415, and a toggle member 401 pivotally mounted within the switch housing 415 for movement between a first position 440B in which the first sandwich switch 366B is activated and a second position 440B in which the second sandwich switch 366B is activated. As with the embodiment shown in FIG. 8, the lower leads 392 and lower contacts 394 are screened directly onto the base 407 and a spacing layer 433 is screened over lower leads 392 with openings for the lower contacts 394. An upper elastomeric layer 396 is connected to the spacing layer 433 to provide a gap 412 between the upper contacts 400 and lower contacts 394.

The toggle member 401 is pivotally mounted to an upper surface of the upper elastomeric layer 396 by a fulcrum 449. The toggle member 401 includes a base 447 adapted to receive the fulcrum 449, a handle 451 extending beyond the switch housing 415 to toggle the toggle member 401 between the first and second positions 440A and 440B, and a pair of opposed contact ends 453 and 455 for contacting the tactile domes formed by the elastomeric layer 396 of each sandwich switch 366A–366B. It is to be understood that the number of contact positions may be increased in proportion to the number of sandwich switches to be engaged.

Although the present invention has been described with reference to preferred embodiments, workers skilled in the art will recognize that changes may be made in form and detail without departing from the spirit and scope of the invention. For example, it is to be understood that sandwich switches may be used in a push button switch, or in a momentary switch in side wall switches where the sandwich switches are positioned adjacent the top and/or bottom surfaces of the hearing aid housing and activated by a slide protruding from a side wall of the hearing aid housing.

What is claimed is:

1. A sandwich switch construction for use in a hearing aid, the sandwich switch comprising:

a base surface with a first electrical lead formed thereon, and a deformable elastomeric membrane with a second electrical lead formed thereon in alignment with the first electrical lead, a portion of the elastomeric membrane being spaced apart from the base surface such that the first electrical lead is not in communication with the second electrical lead; and an upper housing rotatably mounted to the base surface, the upper housing having cam contact means fixedly mounted to an underside of the upper housing such that when the upper housing is rotated to a first position the cam contact means contacts and deforms the elastomeric membrane toward the base surface such that the first electrical lead is in electrical communication with the second electrical lead, and such that when the upper housing is rotated to a second position the elastomeric membrane is deformed away from the base surface such that the first electrical lead is not in electrical communication with the second electrical lead.

2. The sandwich switch construction of claim 1, wherein the elastomeric membrane has a ridge operable with the cam contact means.

3. The sandwich switch construction of claim 1, wherein the cam contact means includes a first cam member extending downward for contacting the elastomeric membrane and closing the sandwich switch.

4. The sandwich switch construction of claim 1, wherein the cam contact means includes a first cam member, a second cam member and a third cam member.

5. The sandwich switch construction of claim 1, wherein the base surface is a lower elastomeric layer, and wherein the sandwich switch construction further comprises a stator base below the lower elastomeric layer and to which the lower elastomeric layer is affixed.

6. The sandwich switch construction of claim 5, wherein the lower elastomeric layer is mounted to the stator base such that a portion of the lower elastomeric layer is spaced apart from the stator base forming a gap below the first electrical lead.

7. The sandwich switch construction of claim 6, further comprising a travel spring positioned in the gap for returning the lower elastomeric layer to an original position if deformed by the cam contact means.

8. The sandwich switch construction of claim 6, further comprising a foam donut positioned in each of the plurality of gaps for returning the lower elastomeric layer to an original position if deformed by the cam contact means.

9. The sandwich switch construction of claim 1, further comprising a nonconductive contact brake between the elastomeric membrane and the base surface to assure adequate spacing between the first and second leads when the cam contact means is in the second position.

10. A method of fabricating a sandwich switch for use in hearing aid comprising:

providing a base;

providing electrical paths on the base surface such that a first lead is formed thereon;

providing an elastomeric membrane;

providing circuity paths on the elastomeric membrane such that a second lead is formed therein;

mounting the elastomeric membrane to the base such that the first lead is in alignment with the second lead and such that a portion of the elastomeric membrane is spaced apart from the base surface such that the first and second leads do not communicate with each other; and providing an upper housing rotatably mounted to the base, the upper housing having cam contact means fixedly mounted to an underside of the upper housing for deforming the elastomeric membrane toward the base when the upper housing is rotated to a first position, such that the first electrical lead electrically communicates with the second electrical lead.

11. A hearing aid comprising:

a hearing aid housing adapted for communication with a person's ear;

a sandwich switch within the hearing aid housing for controlling a function of the hearing aid, the sandwich switch including:

a base surface with a first electrical lead formed thereon, and a deformable elastomeric membrane with a second electrical lead formed thereon in alignment with the first electrical lead, a portion of the elastomeric membrane being spaced apart from the base surface such that the first electrical lead is not in communication with the second electrical lead; and an upper housing rotatably mounted to the base surface, the upper housing having cam contact means fixedly mounted to an underside of the upper housing, such that when the upper housing is rotated to a first position the cam contact means contacts and deforms the elastomeric membrane toward the base surface such that the first electrical lead is in electrical communication with the second electrical lead wherein the sandwich switch is closed, and such that when the upper housing is rotated to a second position the elastomeric membrane is deformed away from the base surface such that the first electrical lead is not in electrical communication with the second electrical lead.

12. The sandwich switch construction of claim 11, wherein the elastomeric membrane has a ridge operable with the cam contact means.

* * * * *

UNITED STATES PATENT AND TRADEMARK OFFICE

CERTIFICATE OF CORRECTION

PATENT NO. : 5,463,692

DATED : October 31, 1995

INVENTOR(S) : RICKY L. FACKLER

It is certified that error appears in the above-indentified patent and that said Letters Patent is hereby corrected as shown below:

Col. 8, line 60, after "switch", insert --construction--

Signed and Sealed this

Sixteenth Day of January, 1996

*Attest:*

*Attesting Officer*

BRUCE LEHMAN

*Commissioner of Patents and Trademarks*